US010429086B2

(12) United States Patent
Yoshida et al.

(10) Patent No.: US 10,429,086 B2
(45) Date of Patent: Oct. 1, 2019

(54) HEAT-PUMP EQUIPMENT

(71) Applicant: Mitsubishi Electric Corporation, Tokyo (JP)

(72) Inventors: Jun Yoshida, Tokyo (JP); Taro Hattori, Tokyo (JP); Kazutaka Suzuki, Tokyo (JP); Koji Matsuzawa, Tokyo (JP); Hirokazu Minamisako, Tokyo (JP); Kei Takeyama, Tokyo (JP); Masahiro Hata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 66 days.

(21) Appl. No.: 15/552,621

(22) PCT Filed: May 12, 2015

(86) PCT No.: PCT/JP2015/063641
§ 371 (c)(1),
(2) Date: Aug. 22, 2017

(87) PCT Pub. No.: WO2016/181501
PCT Pub. Date: Nov. 17, 2016

(65) Prior Publication Data

US 2018/0051894 A1 Feb. 22, 2018

(51) Int. Cl.
*F24D 19/10* (2006.01)
*F24D 3/08* (2006.01)
*F24D 17/02* (2006.01)

(52) U.S. Cl.
CPC ..... *F24D 19/1072* (2013.01); *F24D 3/08* (2013.01); *F24D 17/02* (2013.01); *F24D 2200/12* (2013.01); *F24D 2220/08* (2013.01)

(58) Field of Classification Search
CPC .. F24D 17/02; F24D 19/1072; F24D 2200/12; F24D 2220/08; F24D 3/08;
(Continued)

(56) References Cited

U.S. PATENT DOCUMENTS 5,081,846 A 1/1992 Dudley et al.

FOREIGN PATENT DOCUMENTS

DE 10 2007 037 116 A1 11/2008
DE 102007037116 A1 * 11/2008 ..... F24D 19/1072
(Continued)

OTHER PUBLICATIONS

Invitation pursuant to Article 94(3) and Rule 71(1) EPC dated Oct. 26, 2017 corresponding to EP patent application No. 15868655.0.
(Continued)

*Primary Examiner* — Edward F Landrum
*Assistant Examiner* — Chang H. Park
(74) *Attorney, Agent, or Firm* — Posz Law Group, PLC

(57) ABSTRACT

When hot water supply and room heating are requested simultaneously, a hot water supply operation, by which energy saving is achieved without impairing the comfortability in a room, is performed. A heat-pump apparatus of a variable operation capacity type, a primary water circuit, a hot water tank, a room heater, and a controller are provided. The controller sets a hot water supply operation completion target time in the case of a requests for a simultaneous hot water supply and room heating operation, based on a temperature difference between the outdoor air temperature and the indoor temperature, and determines the rotation speed of the compressor in the hot water supply operation completion target time set.

5 Claims, 5 Drawing Sheets

(58) Field of Classification Search
CPC ..... F24F 2221/183; F24H 4/00; F24H 4/02; F24H 4/04; B60H 2001/3272
USPC ..... 62/178
See application file for complete search history.

(56) References Cited

FOREIGN PATENT DOCUMENTS

| | | | | |
|---|---|---|---|---|
| EP | 2 388 530 | A2 | | 11/2011 |
| JP | 03036454 | A | * | 2/1991 |
| JP | 2004-317093 | A | | 11/2004 |

OTHER PUBLICATIONS

The Extended European Search Report dated Feb. 27, 2017 for the corresponding EP application No. 15868655.0.
Chinese Office Action dated Aug. 19, 2016 for the corresponding CN application No. 2016204291937( English translation attached).
International Search Report of the International Searching Authority dated Aug. 11, 2015 for the corresponding International application No. PCT/JP2015/063641 (and English translation).

* cited by examiner

HEAT-PUMP EQUIPMENT

CROSS REFERENCE TO RELATED APPLICATION

This application is a U.S. national stage application of International Application No. PCT/JP2015/063641, filed on May 12, 2015, the contents of which are incorporated herein by reference.

TECHNICAL FIELD

The present invention relates to heat-pump equipment having a heat-pump apparatus as a heat source, and in particular, to heat-pump equipment configured to execute control processing when performing, for example, hot water supply during use of a room heater.

BACKGROUND

Conventional heat-pump equipment (hereinafter referred to as a heat-pump water heater and room heater) that uses a heat-pump apparatus includes a heat exchanger as a heat source and exchanges heat between refrigerant and a heat medium such as water flowing inside, a hot water circuit for storing water, heated by the heat medium, in a hot water storage tank, and a room heater causing heat of the heat medium to be rejected (see, for example, Patent Literature 1).

According to the technology described in Patent Literature 1, when there are demands for both a hot water supply operation to heat water in the hot water storage tank and a room heating operation to heat a room, the operations are performed by distributing the heat quantity generated in the heat-pump apparatus to both.

PATENT LITERATURE

Patent Literature 1: Japanese Unexamined Patent Application Publication No. 2004-317093

In a conventional heat-pump water heater and room heater, when there are demands for both hot water supply and room heating simultaneously, it is necessary to distribute the heat quantity generated in the heat-pump apparatus to both. As the heat quantity is also distributed to the hot water supply side, the room heating capacity in the case of receiving a request for simultaneously performing hot water supply and room heating may be the same or lower compared with the case of a single request for room heating, which may impair comfortability.

As such, in the case of simultaneously performing hot water supply and room heating, in order not to impair the comfortability in the room, the heat-pump apparatus operates with the maximum capacity, with the aim to complete the hot water supply operation within a relatively short time.

However, as a coefficient of performance (hereinafter referred to as COP) of room heating at the time of maximum operation of the heat-pump apparatus is lowered from the best COP exhibited by the heat-pump apparatus, there is a problem that the efficiency deteriorates.

The present invention is intended to overcome the above described problem. An object of the present invention is to provide heat-pump equipment configured to perform a hot water supply operation by which energy saving is achieved without impairing the comfortability in a room when hot water supply and room heating are requested simultaneously.

Heat-pump equipment, according to the present invention, includes a heat-pump apparatus of a variable operation capacity type including a compressor, a heat exchanger, an expansion valve, and an evaporator that are connected sequentially; a heat medium circuit connected with the heat-pump apparatus via the heat exchanger, a tank configured to store water in which heat is exchanged with the heat medium circuit; a room heater connected with the heat medium circuit and configured to reject heat; and a controller configured to control a rotation speed of the compressor, wherein the controller is configured to set a hot water supply time in a case of receiving a request for simultaneous hot water supply and room heating operation in which the water in the tank is heated and also the room heater is used, based on a temperature difference between an outdoor air temperature and an indoor temperature, and determine the rotation speed of the compressor in the hot water supply time set.

Advantageous Effects of Invention

According to the heat-pump equipment of the present invention, a hot water supply time is computed based on a temperature difference between the outdoor air temperature and the indoor temperature during use of the room heater, and a rotation speed of the compressor is determined such that the temperature of the water in the tank reaches a preset temperature most efficiently within the hot water supply time. Thereby, it is possible to perform a hot water supply operation by which energy saving is achieved without impairing the comfortability in the room when hot water supply and room heating are requested simultaneously.

Embodiments of the present invention will be described hereinafter with reference to the drawings.

It should be noted that in each of the drawings, those denoted by the same reference signs are the same or corresponding ones, which are common in the entire description.

Further, forms of the constituent elements shown in the entire description are illustrative and are not limited to those described herein.

EMBODIMENT 1

Figure 1:
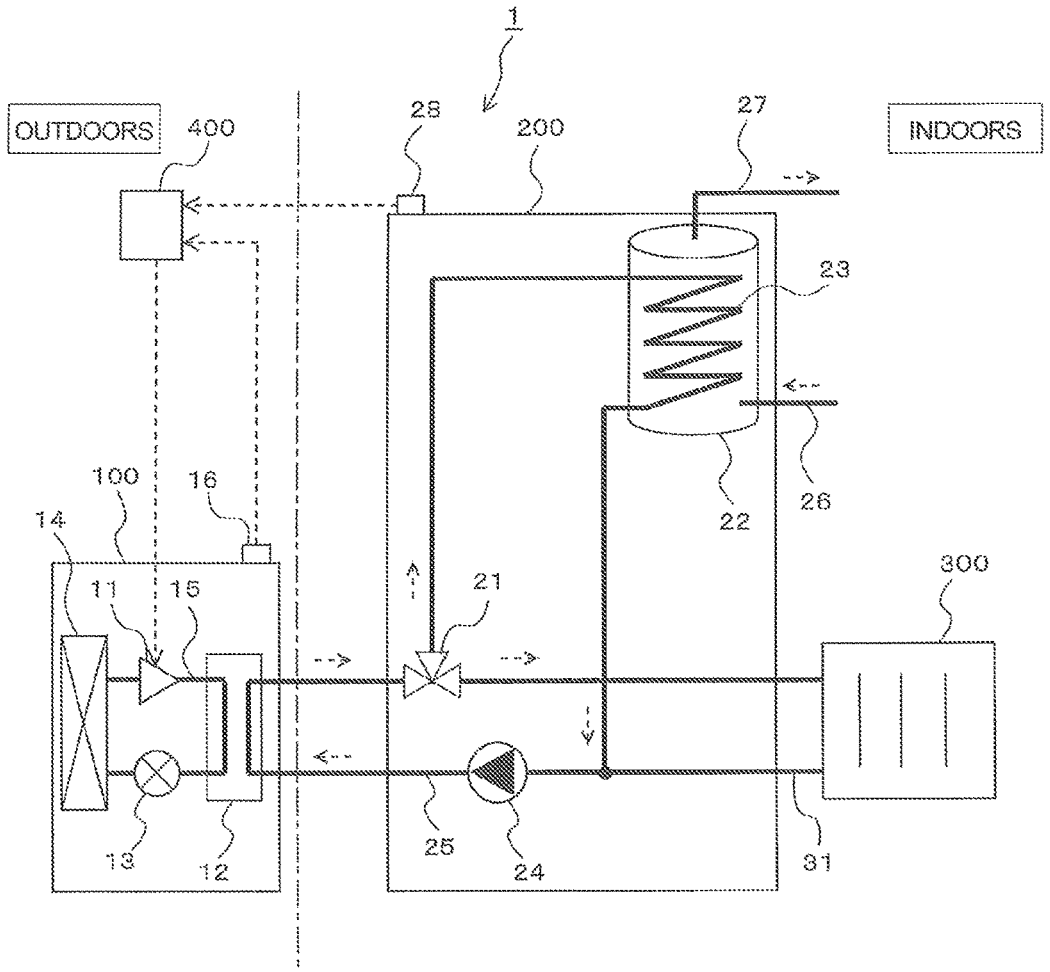
FIG. 1 is a diagram showing a heat-pump water heater and room heater according to Embodiment 1 of the present invention.

FIG. 1 is a diagram showing a schematic configuration of a heat-pump water heater and room heater 1 according to Embodiment 1 of the present invention.

The heat-pump water heater and room heater 1 includes a heat-pump apparatus 100 of a variable operation capacity type, a water heater 200, a room heater 300, and a controller 400.

The heat-pump apparatus 100 is of a variable operation capacity type, and is a heat-pump heat source including a compressor 11, a heat exchanger 12 configured to exchange heat between refrigerant and water as a heat medium, an expansion valve 13, an evaporator 14, a refrigerant circuit 15 connecting them with each other, and an outdoor air temperature sensor 16.

The compressor 11 is configured of a capacity-controllable inverter compressor, for example. The compressor 11 absorbs low-temperature and low-pressure gas refrigerant, compresses it to be in a state of high-temperature and high-pressure gas refrigerant, and discharges it.

The heat exchanger 12 is configured of a plate-type heat exchanger, for example.

The expansion valve 13 reduces the pressure of high-pressure refrigerant to cause it to become low-pressure two-phase refrigerant.

The evaporator 14 is configured of a plate-fin heat exchanger, for example, and exchanges heat between refrigerant and the outside air to evaporate the refrigerant.

The water heater 200 includes a three way valve 21 for changing a flow direction of water in which heat is exchanged by the heat exchanger 12, a hot water tank 22 for storing water heated by water in which heat is exchanged by the heat exchanger 12, an intra-tank heat exchanger 23 configured to exchange heat between the water in which heat is exchanged by the heat exchanger 12 and the water stored in the hot water tank 22, a pump 24, a primary water circuit 25 through which the water in which heat is exchanged by the heat exchanger 12 circulates, a water inlet port 26 from which water is supplied to the hot water tank 22, and a water supply port 27 from which heated water is supplied from the hot water tank 22, and an indoor temperature sensor 28.

The three way valve 21 distributes water, flowing thereto, to one way, another way, or both ways.

The intra-tank heat exchanger 23 is configured of a plate-type heat exchanger, for example.

The pump 24 delivers water.

The room heater 300 includes a heating circuit 31 for distributing water in the primary water circuit 25 to the room heater 300. The room heater 300 rejects heat to the inside of the room by the heated water in the primary water circuit 25.

The controller 400 is configured of a microcomputer, a DSP (Digital Signal Processor), or other devices, and controls the heat-pump apparatus 100 and the water heater 200.

The controller 400 acquires an outdoor air temperature from the outdoor air temperature sensor 16, acquires an indoor temperature from the indoor temperature sensor 28, and controls the rotation speed of the compressor 11 based on the acquired temperatures. As such, the controller 400 stores a program corresponding to the flowchart of FIG. 2 and stores the maps of FIGS. 6 and 7.

Next, operation of the heat-pump water heater and room heater 1 will be described.

When a request for hot water supply or room heating is made, refrigerant, made to be high-temperature and high-pressure by the rotation of the compressor 11, exchanges heat in the heat exchanger 12 with water in the primary water circuit 25. The heated water in the primary water circuit 25 is delivered by the pump 24, and is delivered to the intra-tank heat exchanger 23 while passing through the three way valve 21, and heats the water in the hot water tank 22. In this way, a hot water supply operation is performed. Further, the heated water in the primary water circuit 25 is delivered from the three way valve 21 to the room heater 300 through the heating circuit 31, and rejects heat into the room, whereby a room heating operation is performed. The water heater 200 selectively performs either a hot water supply operation or a room heating operation or both at the same time (simultaneous hot water supply and room heating operation), by the three way valve 21.

Simultaneous hot water supply and room heating operation means performing a hot water supply operation in which water in the hot water tank 22 is heated by the heated water in the primary water circuit 25, and a room heating operation in which the room heater 300 rejects heat into the room by the heated water in the primary water circuit 25, at the same time.

Figure 2:
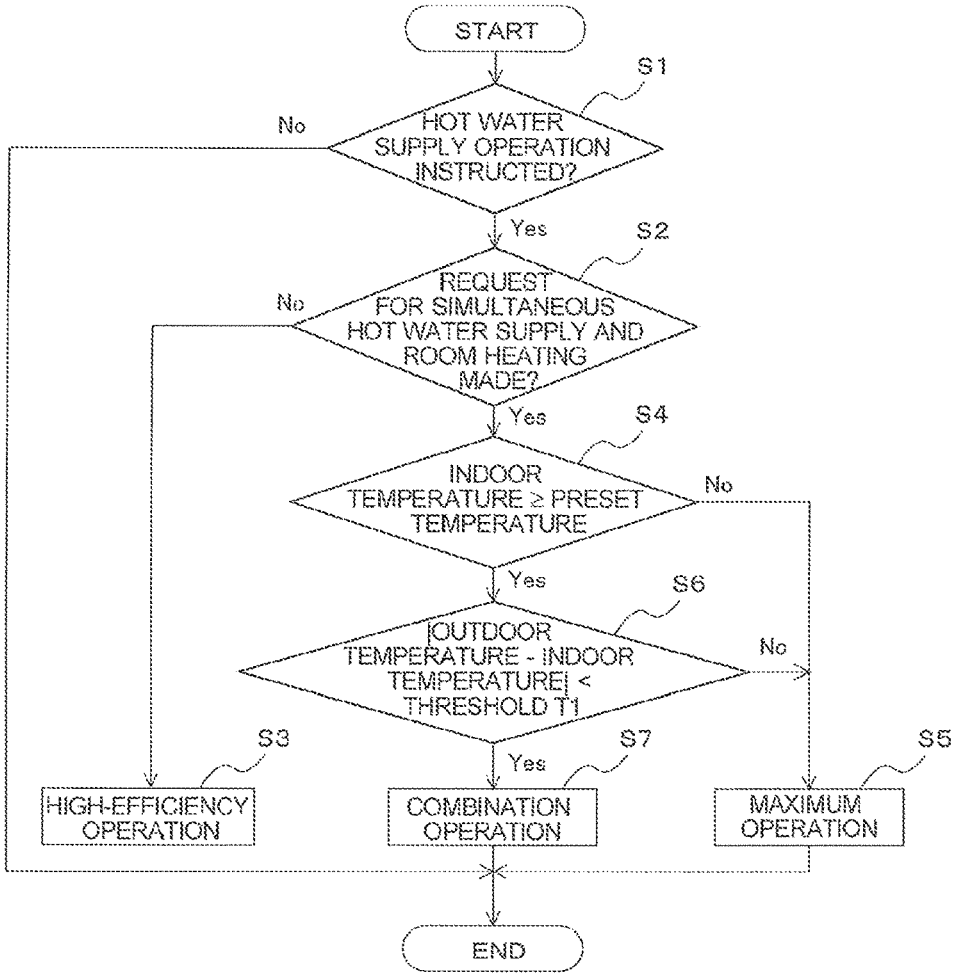
FIG. 2 is a flowchart showing hot water supply control in the heat-pump water heater and room heater according to Embodiment 1 of the present invention.

FIG. 2 is a flowchart showing hot water supply control in the heat-pump water heater and room heater 1 according to Embodiment 1 of the present invention.

Figure 3:
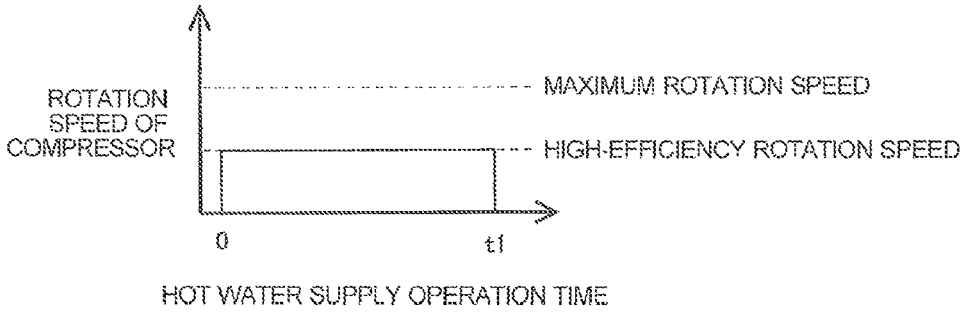
FIG. 3 is a diagram showing a relationship between the hot water supply operation time and the rotation speed of a compressor when a request for a hot water supply operation is made when a room heater according to Embodiment 1 of the present invention is not in use.

FIG. 3 is a diagram showing a relationship between the hot water supply operation time and the rotation speed of the compressor 11 when a request for a hot water supply operation is made when the room heater according to Embodiment 1 of the present invention is not in use. The horizontal axis of FIG. 3 shows the hot water supply operation time, and the vertical axis of FIG. 3 shows the rotation speed of the compressor 11.

Figure 4:
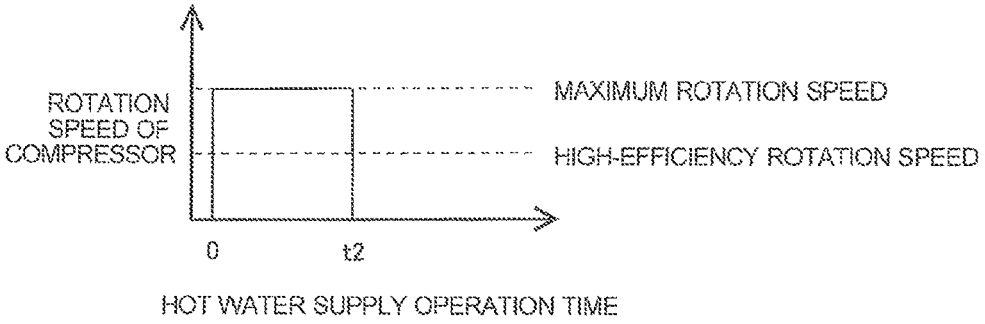
FIG. 4 is a diagram showing a typical relationship between the hot water supply operation time and the rotation speed of a compressor when a request for a hot water supply operation is made during use of a room heater according to Embodiment 1 of the present invention.

FIG. 4 is a diagram showing a typical relationship between the hot water supply operation time and the rotation speed of the compressor 11 when a request for a hot water supply operation is made during use of the room heater according to Embodiment 1 of the present invention. The horizontal axis of FIG. 4 shows the hot water supply operation time, and the vertical axis of FIG. 4 shows the rotation speed of the compressor 11.

Figure 5:
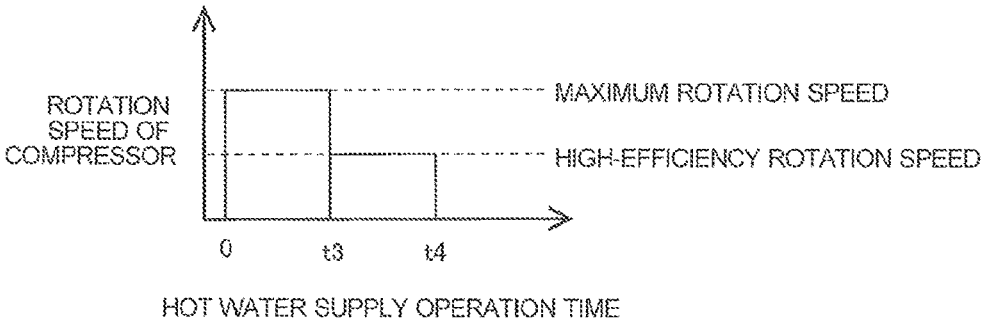
FIG. 5 is a diagram showing a relationship between the hot water supply operation time and the rotation speed of a compressor, when a request for a hot water supply operation is made during use of a room heater and a difference between the outdoor air temperature and the indoor temperature is smaller than a threshold, according to Embodiment 1 of the present invention.

FIG. 5 is a diagram showing a relationship between the hot water supply operation time and the rotation speed of the compressor 11 when a request for a hot water supply operation is made during use of the room heater and a difference between the outdoor air temperature and the indoor temperature is smaller than a threshold T1 according to Embodiment 1 of the present invention. The horizontal axis of FIG. 5 shows the hot water supply operation time, and the vertical axis of FIG. 5 shows the rotation speed of the compressor 11.

Hot water supply control in the heat-pump water heater and room heater 1 will be described based on FIGS. 2 to 5.

When there is a hot water supply operation instruction at step S1, the controller 400 moves to step S2 and determines whether or not there are simultaneous requests for hot water supply and room heating.

When there are no requests for simultaneously performing hot water supply and room heating at step S2, the controller 400 moves to step S3 and performs high-efficiency operation at the time of hot water supply.

In the case of a single request for hot water supply, as the room heater is not used, the comfortability in the room is not affected even if it takes time to heat water. In that case, the rotation speed of the compressor 11 is determined to be a high-efficiency rotation speed which is lower than a maximum rotation speed and is a most efficient rotation speed, and the water in the hot water tank 22 is heated by the high-efficiency operation. This means that the controller 400 determines the rotation speed of the compressor 11 to be a high-efficiency rotation speed. In FIG. 3, a reference character t1 represents a hot water supply operation completion time in the case of high-efficiency operation.

When there are simultaneous requests for hot water supply and room heating at step S2, the controller 400 moves to step S4. At step S4, the controller 400 determines whether or not the indoor temperature detected by the indoor temperature sensor 28 is a preset temperature or higher. At step S4, when the indoor temperature is not the preset temperature or higher, the controller 400 moves to step S5 and performs maximum operation at the time of hot water supply.

In the hot water supply operation, if the time taken for distributing the heat quantity, generated from the heat-pump apparatus 100, to the hot water supply operation side is too long, the indoor temperature is lowered and the comfortability in the room is impaired. As such, with the aim of completing the hot water supply operation within a relatively short time, the controller 400 performs the hot water supply operation by determining the rotation speed of the compressor 11 to be a maximum rotation speed. This means that the controller 400 determines the rotation speed of the compressor 11 to be a maximum rotation speed. In FIG. 4, a reference character t2 represents a hot water supply operation completion time in the case of maximum operation, where a relationship of t2<t1 is established.

At step S4, when the indoor temperature is the preset temperature or higher, the controller 400 moves to step S6. At step S6, the controller 400 determines whether or not a temperature difference between the outdoor air temperature detected by the outdoor air temperature sensor 16 and the indoor temperature detected by the indoor temperature sensor 28 is smaller than the threshold T1. When the temperature difference between the outdoor air temperature and the indoor temperature is not smaller than the threshold T1 at step S6, the controller 400 moves to step S5 and performs maximum operation at the time of hot water supply.

As a temperature difference between the outdoor air temperature and the indoor temperature, an absolute value of a value obtained by subtracting the indoor temperature from the outdoor air temperature is used. The threshold T1 for a temperature difference is a value preset through an experiment, verification, and the like.

When the temperature difference between the outdoor air temperature and the indoor temperature is smaller than the threshold T1 at step S6, the controller 400 moves to step S7 and performs a combination operation for hot water supply.

For example, in Europe where the heat-pump water heater and room heater 1 is used, it is often used by not stopping the room heating operation during winter. As such, there is a condition that a temperature difference between the outdoor air temperature and the indoor temperature is small. Under such a condition that the temperature difference is small, as a drop of the room temperature when the room heating operation is stopped is slow, there is less necessity to finish hot water supply operation as fast as possible to give priority to room heating.

Under the above-described condition, in consideration of both the comfortability in the room and energy saving for boiling, a maximum rotation speed time t3, having been set corresponding to a temperature difference between the outdoor air temperature and the indoor temperature, and a hot water supply operation completion target time t4, at the time of the combination operation, are set. Then, in the initial stage of the combination hot water supply operation, maximum capacity operation (maximum rotation speed operation of the compressor 11) is performed, and in the final stage, high-efficiency operation is performed. This means that in the combination hot water supply operation, the controller 400 determines the rotation speed to be a rotation speed consisting of a combination that the rotation speed of the compressor 11 is set to a maximum rotation speed in the initial stage and the rotation speed of the compressor 11 is set to a high-efficiency rotation speed in the final stage. In FIG. 5, the reference character t3 represents a maximum rotation speed time for continuing the maximum capacity operation, and the reference character t4 represents a hot water supply operation completion target time in the case of combination operation, where a relationship of t3<t2<t4<t1 establishes.

Figure 6:
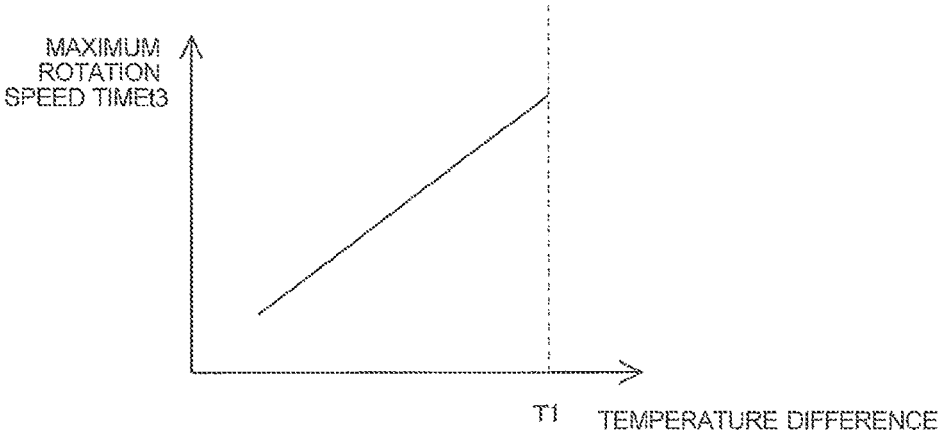
FIG. 6 is a diagram showing a map for setting a time in which a compressor is set to have a maximum rotation speed, when a request for a hot water supply operation is made during use of a room heater and a difference between the outdoor air temperature and the indoor temperature is smaller than a threshold, according to Embodiment 1 of the present invention.

FIG. 6 is a diagram showing a map for setting a time in which the rotation speed of the compressor 11 is set to a maximum rotation speed, when a request for hot water supply operation is made during use of the room heating and when a difference between the outdoor air temperature and the indoor temperature is smaller than the threshold T1, according to Embodiment 1 of the present invention. In FIG. 6, the horizontal axis shows the magnitude of a temperature difference between the outdoor air temperature and the indoor temperature, and the vertical axis shows the length of the maximum rotation speed time t3.

As shown in FIG. 6, when a temperature difference between the outdoor air temperature and the indoor temperature is smaller than the threshold T1 and is relatively large, the maximum rotation speed time t3 is relatively long, getting closer to the hot water supply time t2. This means that the maximum rotation speed time t3, having been set corresponding to the temperature difference between the outdoor air temperature and the indoor temperature, has a proportional correlation. The map of FIG. 6 is stored in the controller 400 in advance.

Figure 7:
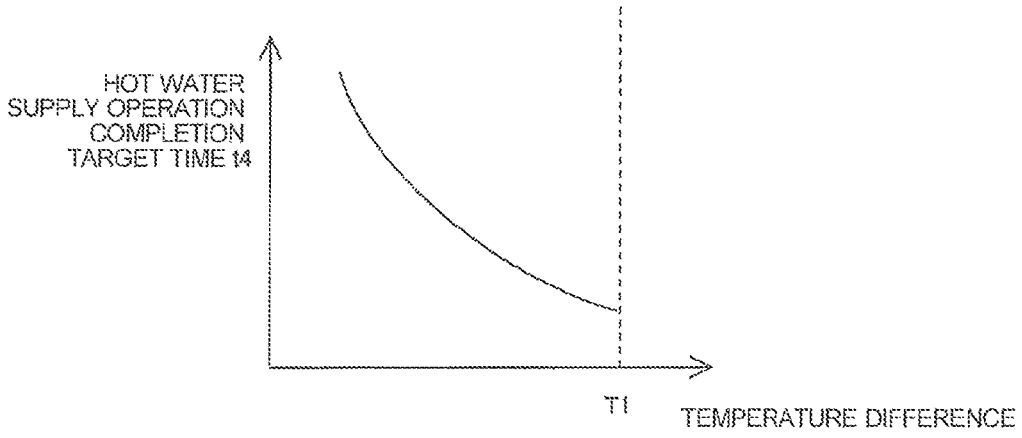
FIG. 7 is a diagram showing a map for setting a hot water supply operation time when a request for a hot water supply operation is made during use of a room heater and a difference between the outdoor air temperature and the indoor temperature is smaller than a threshold, according to Embodiment 1 of the present invention.

FIG. 7 is a diagram showing a map for setting a hot water supply operation time when a request for a hot water supply operation is made during use of the room heater and a difference between the outdoor air temperature and the indoor temperature is smaller than the threshold T1, according to Embodiment 1 of the present invention. In FIG. 7, the horizontal axis shows the magnitude of a temperature difference between the outdoor air temperature and the indoor temperature, and the vertical axis shows the length of the hot water supply operation completion target time t4 at the time of the combination operation.

As shown in FIG. 7, when the temperature difference between the outdoor air temperature and the indoor temperature is smaller than the threshold T1 and is relatively large, the hot water supply operation completion target time t4 at the time of combination operation is relatively short.

On the other hand, when the temperature difference is smaller than the threshold T1 and is relatively small, the hot water supply operation completion target time t4 is relatively longer, getting closer to the hot water supply time t1, and high-efficiency hot water supply operation takes priority. As such, the hot water supply operation completion target time t4 at the time of combination operation, having been set corresponding to the temperature difference between the outdoor air temperature and the indoor temperature, has an inverse correlation. The map of FIG. 7 is stored in the controller 400 in advance.

According to the difference between the maps of FIG. 6 and FIG. 7, the controller 400 is configured to determine, for an increased value of the temperature difference being less than the threshold T1, a decreased value for the hot water supply operation completion target time t4, and increased proportion of duration, in which the rotation speed of the compressor 11 is set to a maximum rotation speed, in the hot water supply operation completion target time t4.

As described above, in the combination operation, the controller 400 sets the maximum rotation speed time t3 and the hot water supply operation completion target time t4 for the combination operation by using the maps of FIG. 6 and FIG. 7, to thereby achieve energy saving for boiling without impairing the comfortability in the room.

It should be noted that even when a request for simultaneously performing hot water supply and room heating is made at step S2, if the indoor temperature does not reach a preset temperature at step S4, hot water supply operation is performed with the rotation speed of the compressor 11 always being the maximum, as shown in FIG. 4, to give priority to the comfortability in the room provided by heating.

Further, even when a request for simultaneously performing hot water supply and room heating is made at step S2, if the temperature difference between the outdoor air temperature detected by the outdoor air temperature sensor 16 and the indoor temperature detected by the indoor temperature sensor 28 is not smaller than the threshold T1 at step S6, the room temperature drops quickly when the room heating operation is stopped. As such, the hot water supply operation is performed in which the rotation speed of the compressor 11 is always the maximum, as shown in FIG. 4.

EMBODIMENT 2

Embodiment 1 includes the intra-tank heat exchanger 23 inside the hot water tank 22. Next, Embodiment 2 having an extra-tank heat exchanger 41 outside the hot water tank 22 will be described. The same configurations and operations as those in Embodiment 1 are denoted by the same reference signs and the description thereof is omitted.

Figure 8:
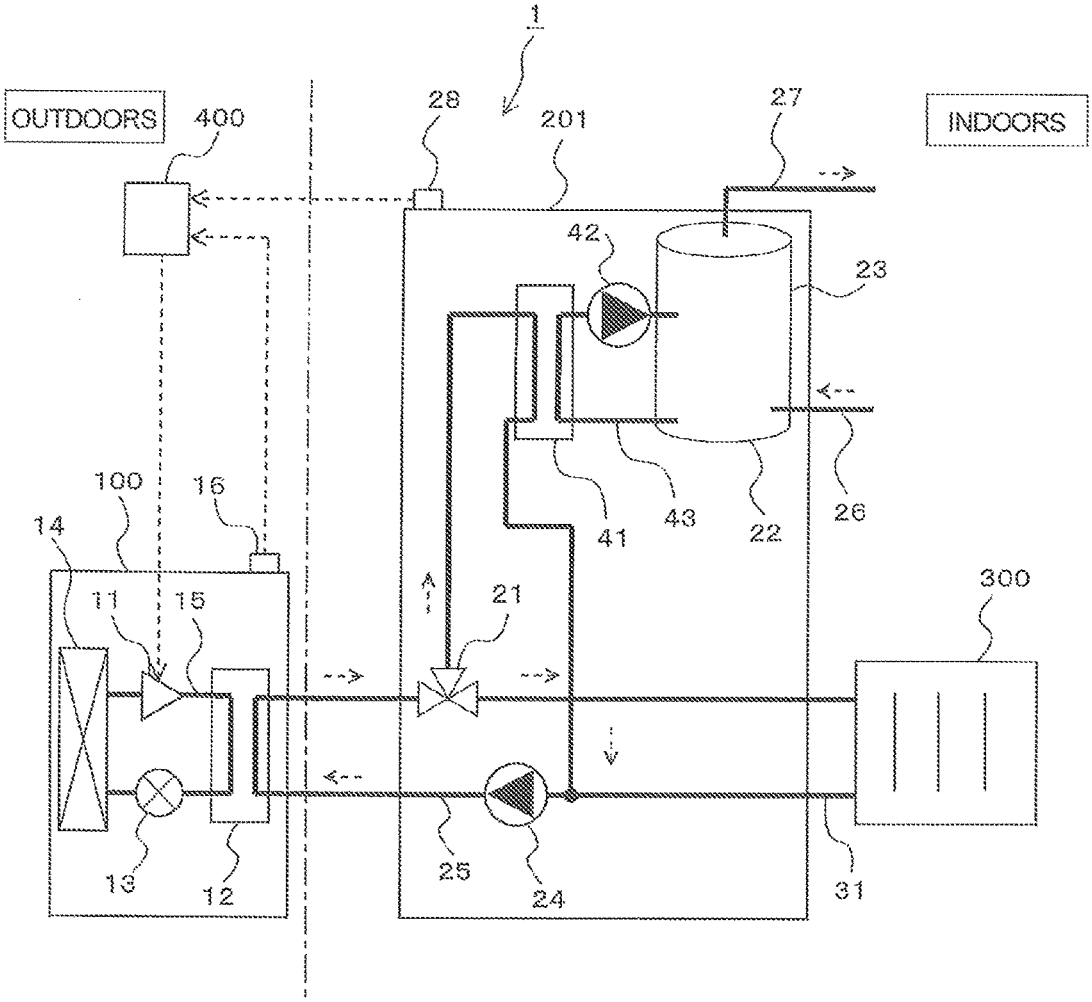
FIG. 8 is a diagram showing a schematic configuration of a heat-pump water heater and room heater according to Embodiment 2 of the present invention.

FIG. 8 is a diagram showing a schematic configuration of a heat-pump water heater and room heater 1 according to Embodiment 2 of the present invention.

The heat-pump water heater and room heater 1 includes a heat-pump apparatus 100 of a variable operation capacity type, a water heater 201, a room heater 300, and a controller 400.

The water heater 201 includes a primary water circuit 25 and a secondary water circuit 43. The primary water circuit 25 connects a three way valve 21, an extra-tank heat exchanger 41, and a pump 24 sequentially via pipes. The secondary water circuit 43 connects a hot water tank 22, a water inlet port 26, a water supply port 27, and a pump 42. The water heater 201 also includes an indoor temperature sensor 28. The primary water circuit 25 of the water heater 201 includes a heating circuit 31 through which water, in which heat is exchanged, flows to the room heater 300. In this way, the extra-tank heat exchanger 41 is provided outside the hot water tank 22.

Next, operation of the heat-pump water heater and room heater 1 will be described.

When a request for hot water supply or room heating is made, a hot water supply operation is performed such that the heated water in the primary water circuit 25, by the heat-pump apparatus 100, is delivered to the extra-tank heat exchanger 41 through the three way valve 21. Further, a room heating operation is performed such that the heated water in the primary water circuit 25 is delivered from the three way valve 21 to room heater 300 flowing through the heating circuit 31. The water, in which heat is exchanged by the extra-tank heat exchanger 41, is delivered by the pump 42 to thereby be stored in the hot water tank 22.

Even in Embodiment 2, by performing hot water supply control of FIG. 2 similar to Embodiment 1, it is possible to achieve energy saving for boiling without impairing the comfortability in the room.

According to Embodiments 1 and 2 described above, the controller 400 causes the water in the hot water tank 22 to be heated and sets the hot water supply operation completion target time t4 in the case of request for a simultaneous hot water supply and room heating operation using the room heater 300, based on the temperature difference between the outdoor air temperature detected by the outdoor air temperature sensor 16 and the indoor temperature detected by the indoor temperature sensor 28. Then, the controller 400 determines the rotation speed of the compressor 11 in the hot water supply operation completion target time t4 set. With this configuration, by calculating the hot water supply operation completion target time t4 based on the temperature difference between the outdoor air temperature and the indoor temperature during use of the room heater, and determining the rotation speed of the compressor 11 to allow the temperature of the water in the hot water tank 22 to be a preset temperature most efficiently within the hot water supply operation completion target time t4, it is possible to perform a hot water supply operation by which energy saving is achieved without impairing the comfortability in the room when hot water supply and room heating are requested simultaneously.

The controller 400 determines the rotation speed of the compressor 11 in the hot water supply operation completion target time t4 to be a rotation speed consisting of a combination of a maximum rotation speed and a high-efficiency rotation speed. With this configuration, it is possible to control the rotation speed of the compressor 11 such that the temperature of the water in the hot water tank 22 reaches a preset temperature most efficiently within the hot water supply operation completion target time t4.

The controller 400 determines the rotation speed of the compressor 11 in the hot water supply operation completion target time t4 to be a rotation speed consisting of a combination of a maximum rotation speed in the initial stage and a high-efficiency rotation speed in the final stage. With this configuration, it is possible to control the rotation speed of the compressor 11 such that the temperature of the water in the hot water tank 22 reaches a preset temperature most efficiently within the hot water supply operation completion target time t4. Further, it is possible to perform hot water supply operation by which energy saving is achieved without impairing the comfortability in the room, when hot water supply and room heating are requested simultaneously.

The controller 400 determines to set the hot water supply operation completion target time t4 to be shorter and increase the proportion of duration, in which the rotation speed of the compressor 11 in the hot water supply operation completion target time t4 is set to a maximum rotation speed, as the temperature difference between the outdoor air temperature and the indoor temperature during use of the room heater is larger. With this configuration, it is possible to perform hot water supply operation by which energy saving is achieved without impairing the comfortability in the room, when hot water supply and room heating are requested simultaneously.

The controller 400 performs processing to determine the rotation speed of the compressor 11 in the hot water supply operation completion target time t4 to be a rotation speed consisting of a combination of a maximum rotation speed and a most efficient rotation speed when the indoor temperature is at a preset temperature or higher by the room heater 300. This is because if the time taken for distributing the heat quantity generated from the heat-pump apparatus 100 is too long in the hot water supply operation side, the indoor temperature drops and the comfortability in the room is impaired.

When the room heater 300 is not used, the controller 400 determines the rotation speed of the compressor 11 in the hot water supply time t1 to be a most efficient rotation speed, while when the room heater 300 is used and the indoor temperature is lower than a preset temperature or a temperature difference between the outdoor air temperature and the indoor temperature is not smaller than the threshold T1, the controller 400 determines the rotation speed of the compressor 11 in the hot water supply time t2 to be a maximum rotation speed, and when the room heater 300 is used and the indoor temperature is a preset temperature or higher and a temperature difference between the outdoor air temperature and the indoor temperature is less than the threshold T1, the controller 400 determines the rotation speed of the compressor 11 in the hot water supply operation completion target time t4 to be a rotation speed consisting of a combination of a maximum rotation speed in the initial stage and a high-efficiency rotation speed in the final stage. With this configuration, it is possible to perform a hot water supply operation by which energy saving is achieved without impairing the comfortability in the room at the time of hot water supply.

The extra-tank heat exchanger 41 configured to exchange heat between the primary water circuit 25 and the water stored in the hot water tank 22 is provided outside the hot water tank 22. With this configuration, it is possible to gradually deliver the water stored in the hot water tank 22 to the extra-tank heat exchanger 41 to thereby heat the water efficiently.

The invention claimed is:

1. Heat-pump equipment comprising:

a heat-pump apparatus of a variable operation capacity type including a compressor, a heat exchanger, an expansion valve, and an evaporator that are connected sequentially;

a heat medium circuit connected with the heat-pump apparatus via the heat exchanger;

a tank configured to store water in which heat is exchanged with the heat medium circuit;

a room heater connected with the heat medium circuit and configured to reject heat; and a controller configured to control a rotation speed of the compressor, wherein the controller is further configured to:

in response to receipt of a request for simultaneous hot water supply and room heating operation in which the water in the tank is heated and also the room heater is used, when a temperature difference between a sensed outdoor air temperature and a sensed indoor temperature reaches a predetermined threshold, control the rotation speed of the compressor to a maximum rotation speed during a hot water supply time, and when the temperature difference does not reach the predetermined threshold, set the hot water supply time to have an initial stage and a final stage, control the rotation speed of the compressor during the initial stage of the hot water supply time to the maximum rotation speed, and then control the rotation speed of the compressor during the final stage of the hot water supply time to a high-efficiency rotation speed, wherein the high-efficiency rotation speed is the rotation speed of the compressor which is lower than the maximum rotation speed and is same as the rotation speed of the compressor when a request for hot water supply operation is made when the room heater is not in use.

2. The heat-pump equipment of claim 1, wherein the controller is further configured to:

set, in response to the temperature difference being increased, a decreased value for the hot water supply time and an increased proportion of duration of the initial stage, in which the rotation speed of the compressor is set to the maximum rotation speed during the hot water supply time, the proportion of duration is a duration of the initial stage in proportion to the hot water supply time.

3. The heat-pump equipment of claim 1, wherein the controller is further configured to when the sensed indoor temperature is at least a preset temperature or more, control the rotation speed of the compressor during the hot water supply time to be a combination comprising both the maximum rotation speed during the initial stage and a the high-efficiency rotation speed during the final stage, when the sensed indoor temperature is less than the preset temperature, control the rotation speed of the compressor during the hot water supply time to be the maximum rotation speed.

4. The heat-pump equipment of claim 1, wherein the controller is further configured to:

when the room heater is not used, control the rotation speed of the compressor during the hot water supply time to be the high-efficiency rotation speed, when the room heater is used and the sensed indoor temperature is lower than a preset temperature or the temperature difference is not smaller than the predetermined threshold, control the rotation speed of the compressor during the hot water supply time to be the maximum rotation speed, and when the room heater is used and the sensed indoor temperature is the preset temperature or higher and the temperature difference is smaller than the predetermined threshold, control the rotation speed of the compressor during the hot water supply time to be a combination comprising both the maximum rotation speed during the initial stage and the high-efficiency rotation speed during the final stage.

5. The heat-pump equipment of claim 1, further comprising an extra-tank heat exchanger configured to exchange heat between the heat medium circuit and the water stored in the tank, the extra-tank heat exchanger being provided outside the tank.

* * * * *